United States Patent [19]

Phillips

[11] 3,997,944

[45] Dec. 21, 1976

[54] DRAPERY HOOK FOR MAINTAINING A DRAPERY HEADING IN UPRIGHT POSITION

[76] Inventor: Carl Ferman Phillips, Rte. 1, Moncure, N.C. 27559

[22] Filed: Sept. 29, 1975

[21] Appl. No.: 617,685

[52] U.S. Cl. ..... 24/86 C; 16/87.4 R

[51] Int. Cl.[2] ..... A47H 13/04

[58] Field of Search ..... 24/150, 86 C, DIG. 13, 24/230.5 FH, 155 SD, 49 P, 263 LS; 16/DIG. 8, 87.6 R, 87.2, 87.4 R; 63/12

[56] References Cited

UNITED STATES PATENTS

| | | | |
|---|---|---|---|
| 526,746 | 10/1894 | Ruffner | 24/155 SD |
| 711,269 | 10/1902 | Wolfberg | 63/12 |
| 733,263 | 7/1903 | Nordt | 63/12 X |
| 1,843,611 | 2/1932 | Knight | 24/230.5 FH |
| 1,945,585 | 2/1934 | Wintrob | 24/86 C UX |
| 2,087,372 | 7/1937 | Crawford | 24/155 SD X |
| 2,796,625 | 6/1957 | Rosenzweig | 16/87.4 R |
| 2,946,107 | 7/1960 | Wilkie | 24/86 C |
| 3,021,552 | 2/1962 | Perlmutter | 16/87.4 R |
| 3,043,587 | 7/1962 | Underhill | 24/263 LS X |
| 3,139,647 | 7/1964 | Cialella | 16/87.4 R |
| 3,609,795 | 10/1971 | Znamirowski et al. | 16/87.4 R |

*Primary Examiner*—Donald A. Griffin
*Attorney, Agent, or Firm*—B. B. Olive

[57] ABSTRACT

A support hook for draperies is provided to maintain the heading of the drapery upright. The hook is made from an integral length of wire and comprises a vertical pin portion which engages the upper hem of the drapery, a clamp portion for holding the pin in place, a U-shaped portion which engages the drapery support rod, an extension portion projecting outwardly from the pin and a stabilizing weight adjustably mounted on the extension for counter-balancing the assembly in order to hold the drapery heading upright.

1 Claim, 6 Drawing Figures

DRAPERY HOOK FOR MAINTAINING A DRAPERY HEADING IN UPRIGHT POSITION

BACKGROUND OF THE INVENTION

1. Field of the Invention:

This invention relates to means for hanging draperies and more specifically to support hooks which engage the drapery and are supported by a drapery rod.

2. Description of the Prior Art:

Numerous hooks, mechanisms, fittings, and the like, have been devised over the years for hanging curtains or draperies. The drapery hook in most common use today has an inverted U-shape with a drapery engaging pin portion extending vertically from the front of the hook (FIG. 1). It is well known that the headings of virtually all drapery hung from such hooks have a tendency to tilt forward. This tilting problem has been recognized for years; and, despite numerous efforts, the drapery industry is still searching for a simple, inexpensive device for supporting the drapery heading in an upright position when installed on the drapery rod. U.S. Pat. Nos. 1,945,585; 1,965,091; 2,813,581; 2,971,213; 3,090,431 and 3,609,795 are illustrative of various drapery support mechanisms and hooks which have been devised in an attempt to solve the tilting problem. However, it is believed that none of the prior art devices provide a suitable approach which is readily adaptable to use with conventional drapery rods, tracks and carriers.

SUMMARY OF THE INVENTION

The drapery hook of the present invention is formed from a continuous piece of wire suitably bent or otherwise shaped. The hook has a vertical pin portion which penetrates the draperies at its upper hem area, a U-shaped portion which engages the drapery support rod and is slidable thereon, a stabilizing extension portion extending back towards the window area and at substantially right angles to the vertical pin portion and a stabilizing weight mounted on the stabilizing extension for adjustable lateral movement thereon depending on the degree of tilt of the drapery heading portion. Adjustment of the stabilizing weight counterbalances the drapery heading and thereby maintains the heading upright upon the drapery rod.

DESCRIPTION OF THE PREFERRED EMBODIMENT

Figure 1:
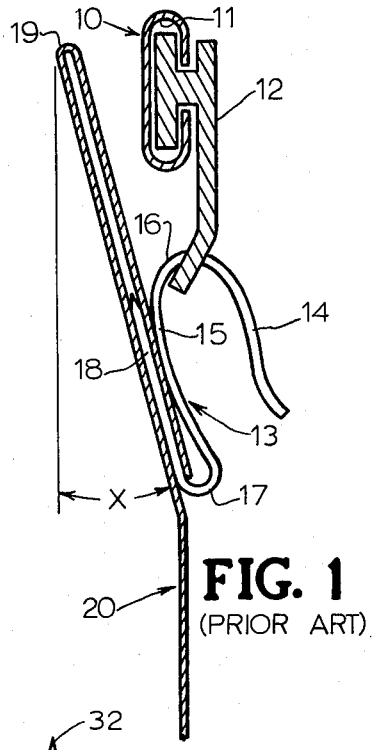
FIG. 1 (PRIOR ART)
FIG. 1 is an elevation view, partially sectioned, of a drapery hook of the prior art type mounted on a drapery rod and supporting the drapery head portion in an undesired outwardly tilted position.

In order to fully explain the construction and advantages of the present invention, a detailed description of the prior art practice will now be made with reference to FIG. 1. A typical drapery rod 10 has mounted in its track 11 a number of drapery carriers 12. Drapery hook 13 is of a well-known type presently in use in the drapery industry. Hook 13 has a free leg 14 and a front shank or leg 15 arranged generally parallel to each another with a U-shaped portion 16 in between. Shank 15 is bent rearwardly at a heel 17 to form an upwardly extending sharpened pin 18. Pin 18 is seated in a gathered portion of a drapery heading 19 formed along the upper edge of a drapery 20. FIG. 1 clearly depicts how drapery heading 19 tilts outwardly at its top and inwardly at its base so as to hang at an angle X from the vertical. This forward tilting of heading 19 is considered to be undesirable, since it spoils the hanging appearance of the drapery.

Figure 2:
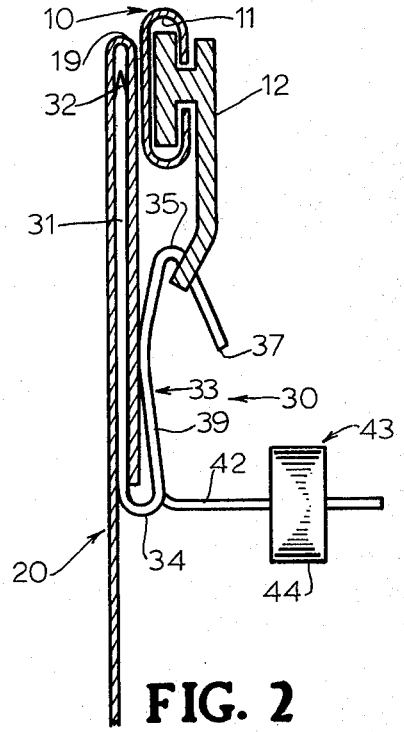
FIG. 2 is an elevation view, partially sectioned, of a drapery hook constructed in accordance with the preferred embodiment of the present invention mounted on a drapery rod and maintaining the drapery head portion in a substantially vertical position.
Figure 3:
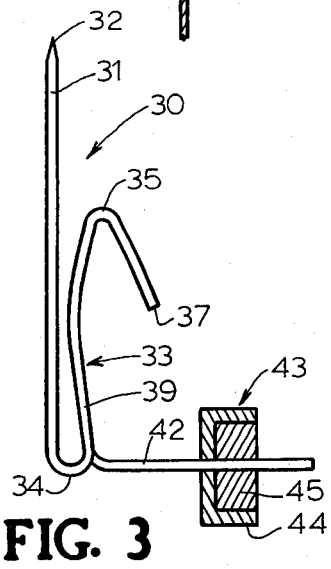
FIG. 3 is an elevation view of the preferred embodiment with the stabilizing weight in section to more clearly illustrate the invention.
Figure 4:
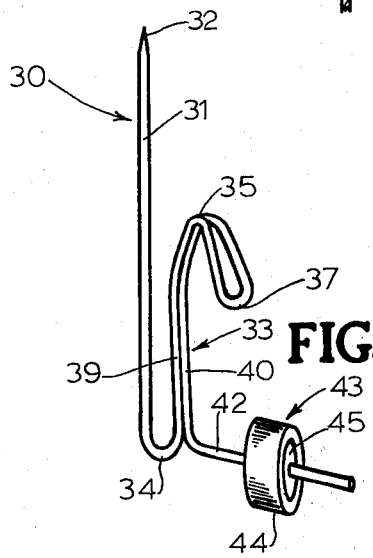
FIG. 4 is a perspective view of the drapery hook of FIGS. 2 and 3.

Turning now to a description of the preferred embodiment of the present invention, FIGS. 2, 3 and 4 will be specifically referred to for illustration. Drapery hook 30 consists of various portions preferably formed from a single continuous piece of wire suitably bent or otherwise shaped. Hook 30 is provided with a pin portion 31 having a point 32 which is adapted for insertion in the heading 19 of drapery 20. When pin 31 has been so inserted, it is clamped in position by a clamp portion 33 which extends upwardly from the heel 34 of pin portion 31. Clamp 33 comprises two wire portions 39, 40 (FIG. 4) which are held in a close spaced relation with the lower part of pin 31 and which have sufficient resiliency to press pin 31 and clamp 33 together with sufficient force to retain drapery 20 in proper position. Drapery hook 30 is so constructed that it can be easily placed on a conventional drapery carrier 12. A U-portion 35 extends from the upper end of clamp 33 and fits on drapery carrier 12. U-portion 35 is formed from continuations of wire portions 39, 40 and has a loop 37 at its tip.

At the base of clamp 33, a stabilizing extension portion 42 extends outwardly at a right angle to pin 31. Extension 42 is adapted to receive a stabilizing weight member 43. In the specific embodiment, weight 43 is made as a hollow lead shell 44 filled with a silicone rubber filler 45. Filler 45 has a hole through its center for receiving extension 42 in a close-fit sliding relationship so that weight 43 can be slid back and forth on extension 42 but will not accidentally slide off. In the specific embodiment, weight 43 weighs approximately 1 ounce and is adapted to slide along extension 42 over a distance of approximately 1½ inches. It has been found that this weight and sliding distance is sufficient to counterbalance a wide range of drapery headings so that they can be held in a vertical position.

Installation of hook 30 is achieved by inserting pin portion 31 into the heading 19 adjacent one of the seams in the drapery pleats. Drapery 20 is clamped in position between pin 31 and clamp 33 of hook 30. There is sufficient resiliency in the lower parts of hook 30 to press pin portion 31 and clamp 33 together with sufficient force to retain drapery 20 in proper position. Weight 33 is adjusted on extension 42 until the proper location is found which will cause heading 19 to be held in an upright position as illustrated in FIG. 2. Hooks 20 can be placed in each drapery seam or may be placed in alternate seams according to the counterbalancing effect which is required by the specific drapery.

Figure 5:
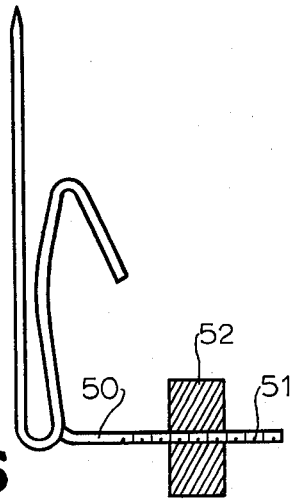
FIG. 5 is a view similar to FIG. 3 and illustrating a second embodiment of the stabilizing weight.

Referring now to FIG. 5, an alternative embodiment of the present invention is illustrated. In this embodiment, stabilizing extension 50 has screw threads 51 which threadably receive a threaded stabilizing weight member 52. Weight 52 is illustrated as being solid, although a hollow, filled member could be substituted as long as the member had internal threads. Member 52 is adapted to be laterally adjusted by rotating threaded weight 52 back and forth on extension 50 by means of threads 51.

Figure 6:
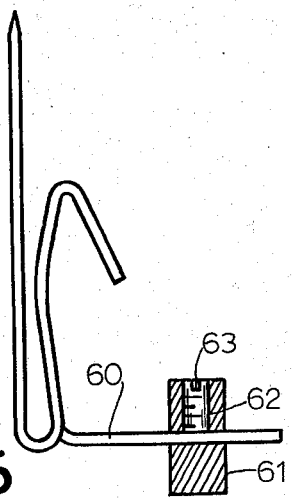
FIG. 6 is a view similar to FIGS. 3 and 5 and illustrating a third embodiment of the stabilizing weight.

FIG. 6 illustrates a further alternative embodiment of the present invention. Stabilizing extension 60, like the extension shown in FIGS. 2, 3 and 4, is formed from a smooth cylindrical wire portion. Stabilizing weight 61 is of solid construction with a threaded bore 62 therein for receiving set screw 63. Once weight 61 is properly positioned on extension 60, set screw 63 is tightened down on extension 60 to lock weight 61 in the desired position.

In summary, the present invention provides a novel and useful drapery hook which has means for counterbalancing the drapery heading to hold it vertical and thereby solve a problem which has for years perplexed those skilled in the art. Although the present invention has been described as preferably comprising a single bent wire strip, it should be understood that the stability extension and weight member can be suitably affixed to any hook-type drapery hanging device in order to counterbalance the drapery heading.

What is claimed is:

1. A drapery hook for mounting and suspending drapery from a drapery rod and adapted to allow the heading of said drapery to be maintained in a substantially vertical position, said drapery hook being formed from an integral length of wire material and comprising:

a. a pointed pin portion having an upper pointed end and a lower heel end and adapted for insertion into said drapery heading;

b. a clamp portion extending upwardly from the heel of said pin portion;

c. a U-shaped portion extending from the upper end of said clamp portion, said U-shaped portion adapted to hang over said drapery rod and be suspended therefrom;

d. a stabilizing extension portion extending from said clamp portion at substantially a right angle to said pin portion; and e. a stabilizing weight member mounted on said stabilizing extension and adapted for longitudinal displacement thereon.

* * * * *

UNITED STATES PATENT OFFICE

CERTIFICATE OF CORRECTION

Patent No. 3,997,944 Dated December 21, 1976

Inventor(s) Carl Ferman Phillips

It is certified that error appears in the above-identified patent and that said Letters Patent are hereby corrected as shown below:

Col. 2, line 65, "33" should be --43--.

Col. 2, line 67, "20" should be --30--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*